US010099232B2

(12) United States Patent
Aono et al.

(10) Patent No.: US 10,099,232 B2
(45) Date of Patent: Oct. 16, 2018

(54) ELECTROSTATIC ATOMIZING DEVICE

(71) Applicant: PANASONIC INTELLECTUAL PROPERTY MANAGEMENT CO., LTD., Osaka (JP)

(72) Inventors: Tetsunori Aono, Hyogo (JP); Tomohiro Yamaguchi, Shiga (JP); Takafumi Omori, Shiga (JP); Osamu Imahori, Shiga (JP); Takayuki Nakada, Shiga (JP); Youhei Ishigami, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/656,503

(22) Filed: Jul. 21, 2017

(65) Prior Publication Data

US 2018/0029053 A1 Feb. 1, 2018

(30) Foreign Application Priority Data

Aug. 1, 2016 (JP) ..... 2016-151592

(51) Int. Cl.

| | |
|---|---|
| ***B05B 5/00*** | (2006.01) |
| ***B05B 5/053*** | (2006.01) |
| ***B05B 5/16*** | (2006.01) |
| ***B05B 5/025*** | (2006.01) |
| ***B05B 5/057*** | (2006.01) |

(52) U.S. Cl.

CPC ..... *B05B 5/0535* (2013.01); *B05B 5/0255* (2013.01); *B05B 5/057* (2013.01); *B05B 5/16* (2013.01)

(58) Field of Classification Search

CPC ..... B05B 5/0535; B05B 5/0255; B05B 5/057

USPC ..... 239/690

See application file for complete search history.

(56) References Cited

U.S. PATENT DOCUMENTS

| | | | |
|---|---|---|---|
| 6,679,441 | B1 | 1/2004 | Borra et al. |
| 2010/0297213 | A1 | 11/2010 | Dupont et al. |
| 2012/0126041 | A1 | 5/2012 | Nunomura et al. |

FOREIGN PATENT DOCUMENTS

| | | | |
|---|---|---|---|
| EP | 486198 | A1 | 5/1992 |
| EP | 1894634 | A1 | 3/2008 |
| FR | 2776538 | A1 | 10/1999 |
| FR | 2926466 | A1 | 7/2009 |

(Continued)

OTHER PUBLICATIONS

The Extended European Search Report dated Nov. 30, 2017 for the related European Patent Application No. 17182473.3.

*Primary Examiner* — Steven J Ganey

(74) *Attorney, Agent, or Firm* — McDermott Will & Emery LLP

(57) ABSTRACT

An electrostatic atomizing device of the present disclosure includes a discharge electrode, a counter electrode, a liquid supplying unit, a current path, a voltage applicator, and a limiting resistor. The limiting resistor is disposed on a first current path or a second current path included in the current path. The first current path electrically connects the voltage applicator and the counter electrode, and the second current path electrically connects the voltage applicator and the discharge electrode. This makes it possible to increase an amount of generated radicals while keeping an increase of ozone small. In addition, an electric current peak of an instantaneous electric current can be kept small.

7 Claims, 17 Drawing Sheets

(56) References Cited

FOREIGN PATENT DOCUMENTS

| | | | |
|---|---|---|---|
| JP | 2011-067738 | A | 4/2011 |
| WO | 2010/110487 | A1 | 9/2010 |

ELECTROSTATIC ATOMIZING DEVICE

RELATED APPLICATIONS

This application claims the benefit of Japanese Application No. 2016-151592, filed on Aug. 1, 2016, the entire disclosure of which Application is incorporated by reference herein.

BACKGROUND

1. Technical Field

The present disclosure relates to an electrostatic atomizing device. More specifically, the present disclosure relates to an electrostatic atomizing device that generates a charged microparticle liquid by electrostatically atomizing a liquid held on a discharge electrode.

2. Description of the Related Art

In a conventional electrostatic atomizing device, corona discharge is caused in a state where a liquid is held on a discharge electrode, and the liquid is electrostatically atomized by energy of the corona discharge, as described in Unexamined Japanese Patent Publication No. 2011-67738. In this way, a charged microparticle liquid containing radicals is generated.

Regarding an electrostatic atomizing device, there are demands for an increase in generated amount of radicals and for suppression of occurrence of ozone. It is, however, difficult for the conventional electrostatic atomizing device to meet both of these two demands.

SUMMARY

An object of the present disclosure is to provide an electrostatic atomizing device that makes it possible to increase a generated amount of radicals while keeping an increase of ozone small.

In order to attain the object, an electrostatic atomizing device of the present disclosure includes: a discharge electrode; a counter electrode that is located so as to face the discharge electrode; a liquid supplying unit that supplies a liquid for electrostatic atomization to the discharge electrode; a current path that electrically connects the discharge electrode and the counter electrode; a voltage applicator that is disposed on the current path, applies a voltage across the discharge electrode and the counter electrode, and thus intermittently generates a discharge path due to dielectric breakdown so that the discharge electrode and the counter electrode are connected to each other; and a limiting resistor that is disposed on the current path.

The limiting resistor is disposed on a first current path or a second current path included in the current path. The first current path electrically connects the voltage applicator and the counter electrode, and the second current path electrically connects the voltage applicator and the discharge electrode.

Since a large instantaneous electric current flows through a discharge path created by dielectric breakdown, the configuration makes it possible to generate a larger amount of radicals than an amount of radicals generated by corona discharge and to discharge a charged microparticle liquid containing the radicals to an outside while keeping an increase of ozone small.

The electrostatic atomizing device of the present disclosure produces an effect that a generated amount of radicals can be increased while an increase in ozone is being kept small and an effect that an electric current peak of an instantaneous electric current can be kept small.

DETAILED DESCRIPTION

Figure 1:
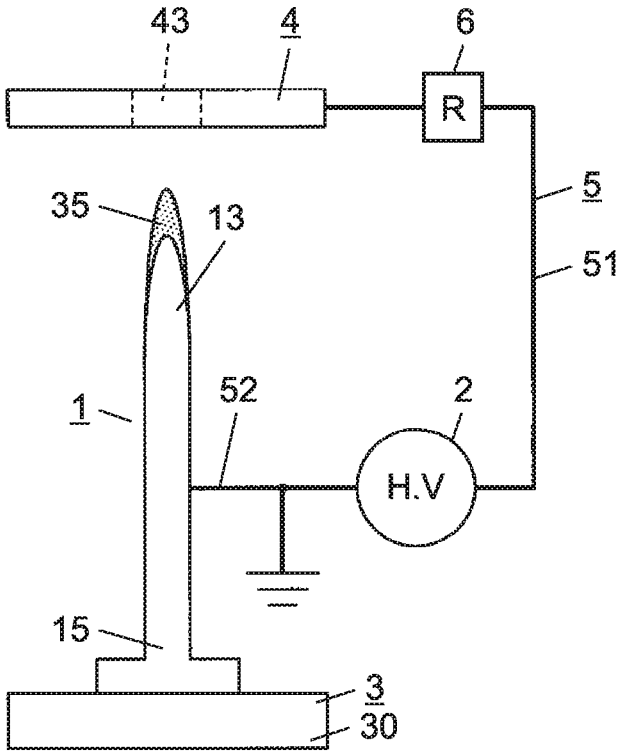
FIG. 1 is a schematic view illustrating an electrostatic atomizing device according to a first exemplary embodiment.

A first aspect of the present disclosure provides an electrostatic atomizing device including: a discharge electrode; a counter electrode that is located so as to face the discharge electrode; a liquid supplying unit that supplies a liquid for electrostatic atomization to the discharge electrode; a current path that electrically connects the discharge electrode and the counter electrode; a voltage applicator that is disposed on the current path, applies a voltage across the discharge electrode and the counter electrode, and thus intermittently generates a discharge path due to dielectric breakdown so that the discharge electrode and the counter electrode are connected to each other; and a limiting resistor that is disposed on the current path. The limiting resistor is disposed on a first current path or a second current path included in the current path. The first current path electrically connects the voltage applicator and the counter electrode, and the second current path electrically connects the voltage applicator and the discharge electrode.

According to the first aspect of the present disclosure, since a large instantaneous electric current flows through a discharge path created by dielectric breakdown, radicals can be generated by larger energy than energy in corona discharge and a charged microparticle liquid containing the radicals can be discharged to an outside while an increase of ozone is being kept small. In addition, since the limiting resistor prevents an electric current peak of the instantaneous electric current from becoming too high, occurrence of NOx and influence of electric noise are kept small.

A second aspect of the present disclosure provides the electrostatic atomizing device according to the first aspect of the present disclosure, in which the limiting resistor is disposed on the first current path, and a length of a wire between the counter electrode and the limiting resistor on the first current path is set to 30 mm or less. With the configuration, discharge occurring between the discharge electrode and the counter electrode is less likely to become unstable due to influence of floating capacitance of the wire.

A third aspect of the present disclosure provides the electrostatic atomizing device according to the second aspect of the present disclosure, in which the limiting resistor is directly connected to the counter electrode electrically and mechanically. With the configuration, discharge occurring between the discharge electrode and the counter electrode is less likely to become unstable due to influence of floating capacitance of the wire.

A fourth aspect of the present disclosure provides the electrostatic atomizing device according to the first aspect of the present disclosure, in which the limiting resistor is disposed on the first current path, and a length of a wire between the voltage applicator and the limiting resistor on the first current path is set to 200 mm or less. With the configuration, discharge occurring between the discharge electrode and the counter electrode is less likely to become unstable due to influence of floating capacitance of the wire.

A fifth aspect of the present disclosure provides the electrostatic atomizing device according to the first aspect of the present disclosure, in which the limiting resistor is disposed on the second current path, and a length of a wire between the discharge electrode and the limiting resistor on the second current path is set to 30 mm or less. With the configuration, discharge occurring between the discharge electrode and the counter electrode is less likely to become unstable due to influence of floating capacitance of the wire.

A sixth aspect of the present disclosure provides the electrostatic atomizing device according to the first aspect of the present disclosure, in which the limiting resistor is disposed on the second current path, and a length of a wire between the voltage applicator and the limiting resistor on the second current path is set to 200 mm or less. With the configuration, discharge occurring between the discharge electrode and the counter electrode is less likely to become unstable due to influence of floating capacitance of the wire.

A seventh aspect of the present disclosure provides the electrostatic atomizing device according to the first aspect of the present disclosure, in which the limiting resistor is a resistor that includes a resistive element and a lead wire electrically connected to the resistive element, and the lead wire is covered with a cover for making the lead wire harder to be bent. The cover makes it possible to keep a large radius of curvature during bending of the lead wire, and thus breakage of the lead wire can be made to be less likely to occur.

An eighth aspect of the present disclosure provides the electrostatic atomizing device according to the first aspect of the present disclosure, further including a fixing base on which the limiting resistor is fixed. The limiting resistor is a resistor that includes a resistive element and a lead wire electrically connected to the resistive element. This inhibits repeated bending of the lead wire, and thus breakage of the lead wire can be made to be less likely to occur.

Embodiments of the present disclosure will be described below with reference to the drawings. The present disclosure is not limited to the embodiments below, and configurations in the embodiments below may be combined as appropriate.

First Exemplary Embodiment

FIG. 1 illustrates a basic configuration of an electrostatic atomizing device according to a first exemplary embodiment. The electrostatic atomizing device according to the present exemplary embodiment includes discharge electrode 1, voltage applicator 2, liquid supplying unit 3, counter electrode 4, current path 5, and limiting resistor 6.

Discharge electrode 1 is a long thin electrode having a needle shape. Discharge electrode 1 has front-end portion 13 at one end, in an axial direction, of discharge electrode 1 and has base-end portion 15 at the other end, in the axial direction, of the discharge electrode 1 (on a side opposite to front-end portion 13). The term "needle shape" as used herein encompasses not only a case where a front end is sharply pointed, but also a case where a front end is rounded.

Voltage applicator 2 is electrically connected to discharge electrode 1 and counter electrode 4 so that a high voltage is applied across discharge electrode 1 and counter electrode 4.

Liquid supplying unit 3 is a unit that supplies liquid 35 for electrostatic atomization to discharge electrode 1. In the electrostatic atomizing device according to the present exemplary embodiment, liquid supplying unit 3 is realized by cooler 30 that generates dew condensation water by cooling discharge electrode 1. Cooler 30 is in contact with base-end portion 15 of discharge electrode 1 and cools whole discharge electrode 1 through base-end portion 15. Liquid 35 supplied to discharge electrode 1 by liquid supplying unit 3 is dew condensation water generated on discharge electrode 1. A different unit may be provided as liquid supplying unit 3, and a liquid other than water may be supplied as liquid 35.

Counter electrode 4 is located so as to face front-end portion 13 of discharge electrode 1. Counter electrode 4 has opening 43 in a central portion of counter electrode 4. Opening 43 passes through counter electrode 4 in a thickness direction of counter electrode 4. Counter electrode 4 has opening 43 in a region closest to front-end portion 13 of discharge electrode 1. A direction in which opening 43 passes and an axial direction of discharge electrode 1 are parallel with each other. The term "parallel" as used herein encompasses not only "strictly parallel", but also "substantially parallel".

Current path 5 is a current path through which counter electrode 4 is electrically connected to discharge electrode 1, and voltage applicator 2 is disposed in a middle of current path 5. That is, current path 5 includes first current path 51 that electrically connects voltage applicator 2 and counter electrode 4, and second current path 52 that electrically connects voltage applicator 2 and discharge electrode 1.

Limiting resistor 6 is disposed in a middle of current path 5. Specifically, limiting resistor 6 is disposed in a middle of first current path 51 of current path 5.

In the electrostatic atomizing device according to the present exemplary embodiment, discharge is caused between discharge electrode 1 and counter electrode 4 by applying a high voltage of approximately 7.0 kV across discharge electrode 1 and counter electrode 4 by voltage applicator 2 while liquid 35 is being held on discharge electrode 1.

In the electrostatic atomizing device according to the present exemplary embodiment, first, local corona discharge is generated at front-end portion 13 of discharge electrode 1 (a front end of liquid 35 held on front-end portion 13), and this corona discharge is developed into discharge of higher energy. In this discharge of higher energy, a discharge path intermittently (in a pulse manner) occurs due to dielectric breakdown (total breakdown) so as to connect discharge electrode 1 and counter electrode 4. This form of discharge is referred to as "leader discharge".

Figure 2A:
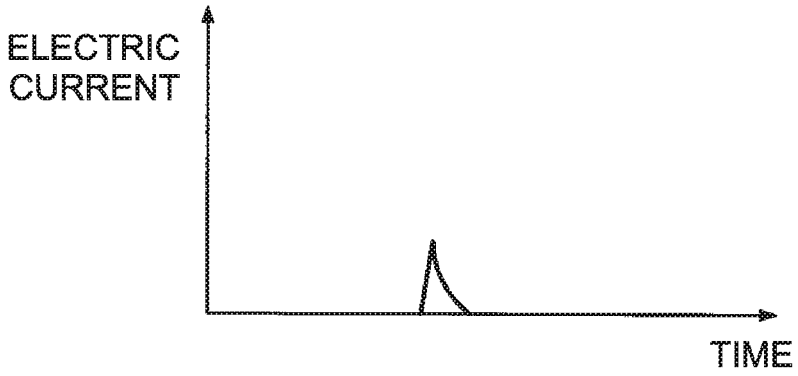
FIG. 2A is a graph schematically illustrating an electric current flowing in corona discharge.
Figure 2B:
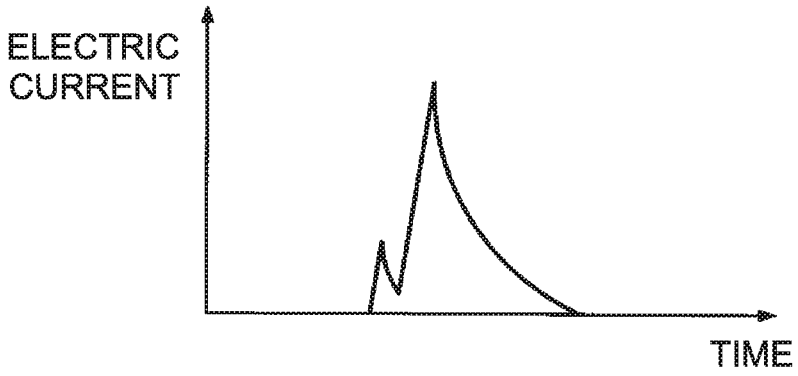
FIG. 2B is a graph schematically illustrating an electric current flowing in leader discharge.

In the leader discharge, an instantaneous electric current that is approximately 2 to 10 times as high as an electric current in the corona discharge flows through the discharge path that occurs due to dielectric breakdown between discharge electrode 1 and counter electrode 4. FIG. 2A schematically illustrates an electric current flowing in the corona discharge, and FIG. 2B schematically illustrates an electric current flowing in the leader discharge developed from the corona discharge. In the leader discharge, a large amount of radicals that is approximately two to ten times as large as an amount of radicals generated in the corona discharge are generated. The large amount of radicals generated by the leader discharge are discharged to an outside in a state that the radicals are contained in a charged microparticle liquid.

Ozone is also generated at this timing. However, an amount of ozone generated in the leader discharge is kept approximately same as an amount of ozone generated in the corona discharge while an amount of radicals generated in the leader discharge is approximately two to ten times as large as an amount of radicals generated in the corona discharge. That is, by developing the corona discharge into the leader discharge, an amount of generated ozone relative to an amount of generated radicals is kept markedly small. This is considered to be because part of generated ozone is broken by the high-energy leader discharge during release of the ozone under exposure to the leader discharge.

The leader discharge is described in more detail below.

In general, when discharge is generated by inputting energy between a pair of electrodes, a discharge form develops from corona discharge to glow discharge and then to arc discharge in accordance with an amount of input energy.

The corona discharge is discharge that occurs locally at one electrode and does not involve dielectric breakdown between electrodes. The glow discharge and the arc discharge are discharge that involves dielectric breakdown between the pair of electrodes, and a discharge path created by the dielectric breakdown continuously exists during input of the energy.

Meanwhile, the leader discharge involves dielectric breakdown between the pair of electrodes, but the dielectric breakdown does not continuously occur but intermittently occurs.

In the electrostatic atomizing device according to the present exemplary embodiment, electrical capacitance of voltage applicator 2 (capacitance of electricity that can be discharged per unit time) is set so that this form of leader discharge occurs between discharge electrode 1 and counter electrode 4. That is, in the electrostatic atomizing device according to the present exemplary embodiment, the electrical capacitance of voltage applicator 2 is set so that when the corona discharge develops into dielectric breakdown, a large instantaneous electric current flows through a discharge path created by the dielectric breakdown, but immediately afterwards a voltage drop and stoppage of the discharge occur and a subsequent rise in voltage causes dielectric breakdown in a repetitive manner. By thus setting the capacitance, the leader discharge is achieved in which instantaneous dielectric breakdown and stoppage of discharge are alternately repeated, instead of continuous dielectric breakdown as in the case of glow discharge and arc discharge.

In one example of confirmation so far, a discharge frequency (a frequency of an instantaneous electric current) in the leader discharge is approximately 50 Hz to 10 kHz, and one pulse width is approximately 200 ns at most. As described above, the leader discharge is clearly different from the glow discharge and arc discharge in that instantaneous discharge (a high-energy state) and stoppage of discharge (a low-energy state) are alternated.

In the electrostatic atomizing device according to the present exemplary embodiment, liquid 35 supplied to discharge electrode 1 by liquid supplying unit 3 is electrostatically atomized by the leader discharge, and thus a nanometer-size charged microparticle liquid containing radicals is generated. The generated charged microparticle liquid is discharged to an outside through opening 43. The charged microparticle liquid generated by the leader discharge contains a larger amount of radicals than a charged microparticle liquid generated by corona discharge. Furthermore, an amount of ozone generated by the leader discharge is kept almost equivalent to an amount of ozone generated by corona discharge.

In the leader discharge, an instantaneous electric current flows through a discharge path created by dielectric breakdown, and electric current resistance is very small during the flow of the instantaneous electric current. In view of this, in the electrostatic atomizing device according to the present exemplary embodiment, an electric current peak of the instantaneous electric current is kept small by providing limiting resistor 6 on first current path 51. Keeping an electric current peak of the instantaneous electric current small produces an advantage of keeping occurrence of NOx small and an advantage of preventing influence of electric noise from becoming too large. Limiting resistor 6 is not limited to one using a dedicated element and can have any configuration as long as limiting resistor 6 has preset electric resistance.

Figure 3:
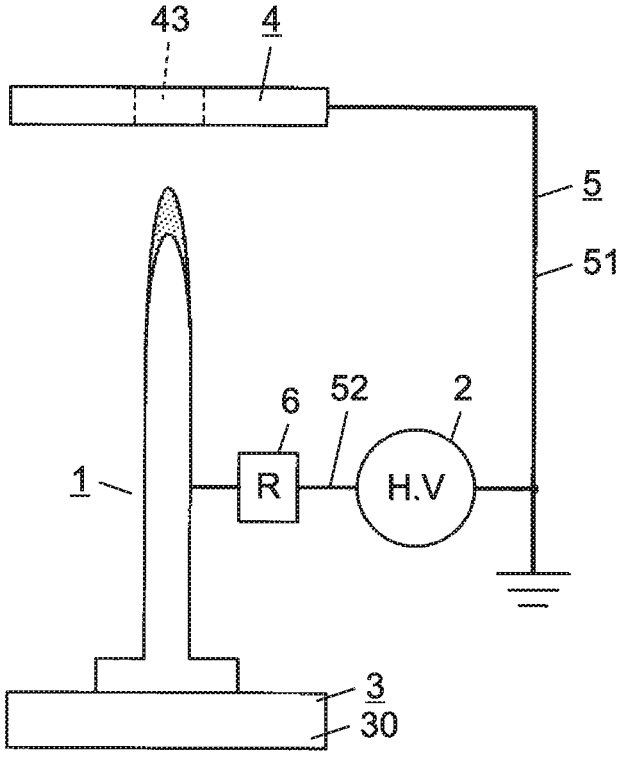
FIG. 3 is a schematic view illustrating a modification of the electrostatic atomizing device.

FIG. 3 illustrates a modification of the electrostatic atomizing device according to the present exemplary embodiment. In this modification, limiting resistor 6 is disposed in a middle of second current path 52 that electrically connects voltage applicator 2 and discharge electrode 1. Also in this modification, a peak value of an instantaneous electric current of leader discharge is kept small by limiting resistor 6.

Second Exemplary Embodiment

An electrostatic atomizing device according to a second exemplary embodiment is described below with reference to FIGS. 4A and 4B. Detailed description of constituent elements that are similar to those in the first exemplary embodiment is omitted.

Figure 4A:
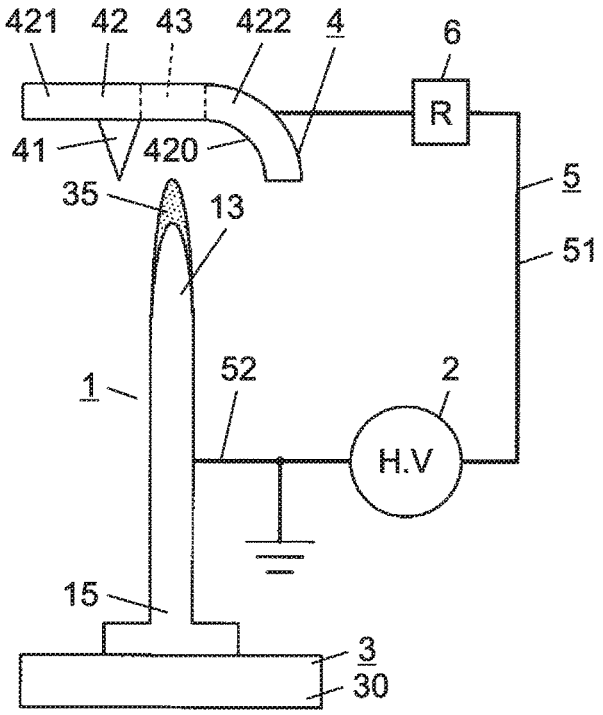
FIG. 4A is a schematic view illustrating an electrostatic atomizing device according to a second exemplary embodiment.

FIG. 4A illustrates a basic configuration of an electrostatic atomizing device according to the present exemplary embodiment. The electrostatic atomizing device according to the present exemplary embodiment is different from the electrostatic atomizing device according to the first exemplary embodiment in that counter electrode 4 includes needle-shaped electrode portion 41 and supporting electrode portion 42 that supports needle-shaped electrode portion 41.

Needle-shaped electrode portion 41 protrudes toward discharge electrode 1 from supporting electrode portion 42. Of all portions of counter electrode 4, a tip of needle-shaped electrode portion 41 is located closest to discharge electrode 1. Needle-shaped electrode portion 41 is located close to opening 43 of counter electrode 4. The electrostatic atomizing device according to the present exemplary embodiment includes single needle-shaped electrode portion 41 but may include a plurality of needle-shaped electrode portions 41.

Supporting electrode portion 42 is constituted by flat-plate-shaped electrode portion 421 that has a flat opposing surface and dome-shaped electrode portion 422 having a concave opposing surface. The opposing surface of electrode portion 421 and the opposing surface of electrode portion 422 constitute opposing surface 420 of supporting electrode portion 42. Opposing surface 420 of supporting electrode portion 42 has a shape formed by combining a flat surface and a concave surface.

Since the electrostatic atomizing device according to the present exemplary embodiment has the above configuration, electric field concentration occurs at needle-shaped electrode portion 41 of counter electrode 4 and front-end portion 13 of discharge electrode 1 (i.e., a front end of liquid 35 held on front-end portion 13), and leader discharge caused by dielectric breakdown stably occurs between needle-shaped electrode portion 41 of counter electrode 4 and front-end portion 13 of discharge electrode 1. In addition, opposing surface 420 of supporting electrode portion 42 further increases the electric field concentration at front-end portion 13 of discharge electrode 1.

Figure 4B:
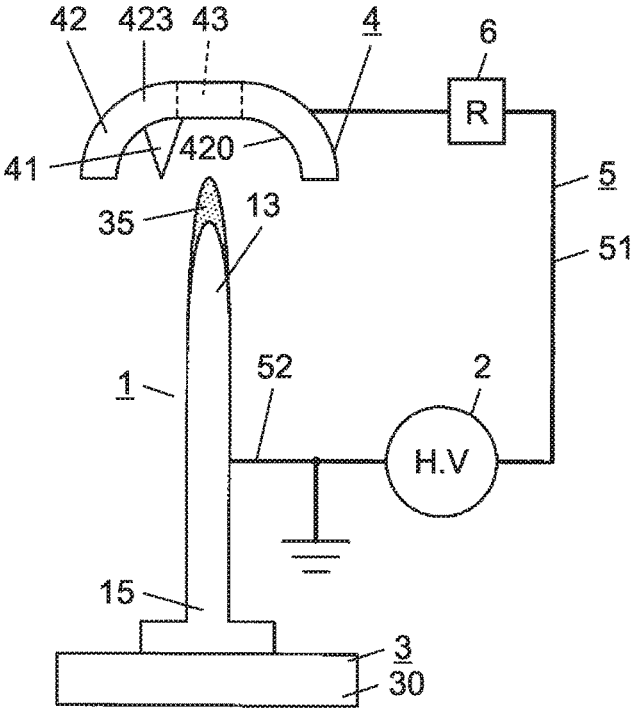
FIG. 4B is a schematic view illustrating a modification of the electrostatic atomizing device.

FIG. 4B illustrates a modification of the electrostatic atomizing device according to the present exemplary embodiment. In this modification, supporting electrode portion 42 is constituted by dome-shaped electrode portion 423 having a concave opposing surface. Opposing surface 420 of supporting electrode portion 42 is a concave surface that is curved in a concave shape around front-end portion 13 of discharge electrode 1.

This modification also produces an advantage of stable occurrence of leader discharge by dielectric breakdown between needle-shaped electrode portion 41 of counter electrode 4 and front-end portion 13 of discharge electrode 1 and an advantage of increased electric field concentration at front-end portion 13 of discharge electrode 1. Opposing surface 420 of supporting electrode portion 42 of counter electrode 4 may have a flat shape, a concave shape, or a combination of a flat shape and a concave shape as appropriate.

Third Exemplary Embodiment

Figure 5:
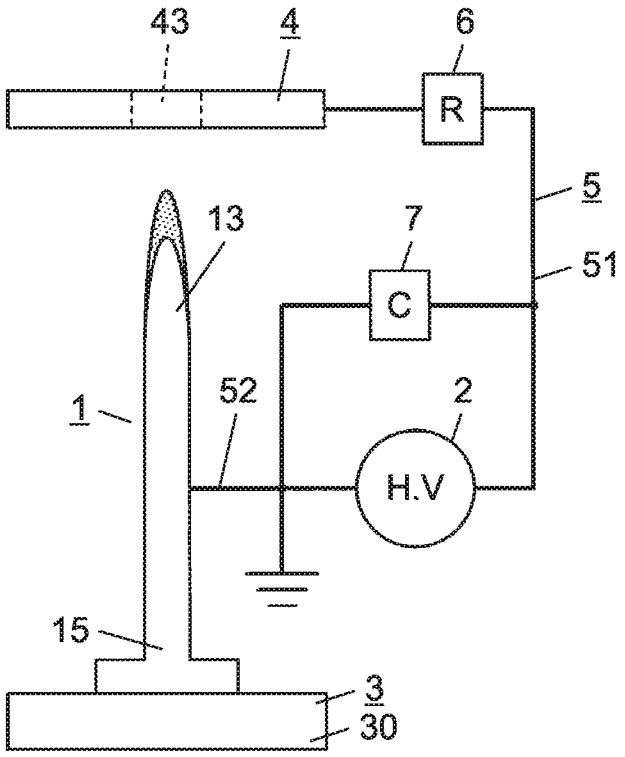
FIG. 5 is a schematic view illustrating an electrostatic atomizing device according to a third exemplary embodiment.

An electrostatic atomizing device according to a third exemplary embodiment is described below with reference to FIG. 5. Detailed description of constituent elements that are similar to those in the first exemplary embodiment is omitted.

In the electrostatic atomizing device according to the present exemplary embodiment, capacitor 7 that adjusts a discharge frequency of leader discharge is disposed in a middle of current path 5. Capacitor 7 is connected in parallel with voltage applicator 2. Since electric current resistance during flow of an instantaneous electric current is very small in leader discharge as described above, the discharge frequency of the leader discharge is effectively adjusted by disposing capacitor 7 on current path 5.

Capacitor 7 is not limited to one using a dedicated element and can have any configuration as long as capacitor 7 has preset capacitance.

Fourth Exemplary Embodiment

Figure 6A:
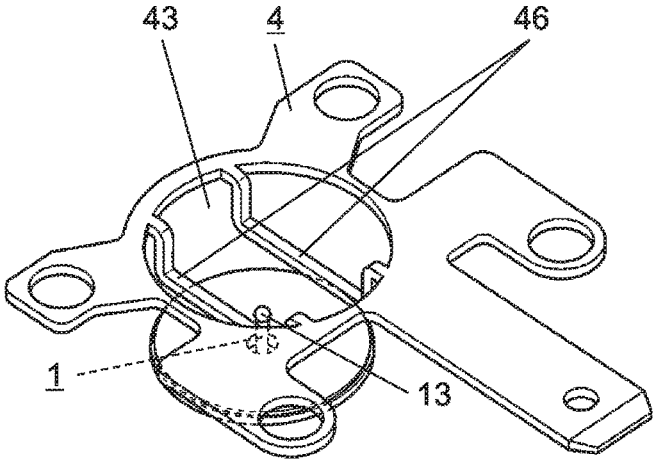
FIG. 6A is a perspective view illustrating a main part of an electrostatic atomizing device according to a fourth exemplary embodiment.

An electrostatic atomizing device according to a fourth exemplary embodiment is described below with reference to FIG. 6A. Detailed description of constituent elements that are similar to those in the second exemplary embodiment is omitted.

In the electrostatic atomizing device according to the present exemplary embodiment, two bar-shaped electrode portions 46 that are parallel with each other are provided so as to be integral with each other in order to stably generate leader discharge involving dielectric breakdown instead of needle-shaped electrode portion 41 that has a sharply pointed surface in the second exemplary embodiment. Counter electrode 4 has circular opening 43. When viewed along an axial direction of discharge electrode 1, two bar-shaped electrode portions 46 are located inside opening 43, and discharge electrode 1 is located between two bar-shaped electrode portions 46. Shortest distances from two bar-shaped electrode portions 46 to front-end portion 13 of discharge electrode 1 are identical to each other. The term "identical" as used herein encompasses not only "strictly identical", but also "substantially identical".

In the electrostatic atomizing device according to the present exemplary embodiment, leader discharge caused by dielectric breakdown can be stably generated between portions, of respective bar-shaped electrode portions 46 of counter electrode 4, that are closest to front-end portion 13 of discharge electrode 1 and front-end portion 13 of discharge electrode 1.

Fifth Exemplary Embodiment

Figure 6B:
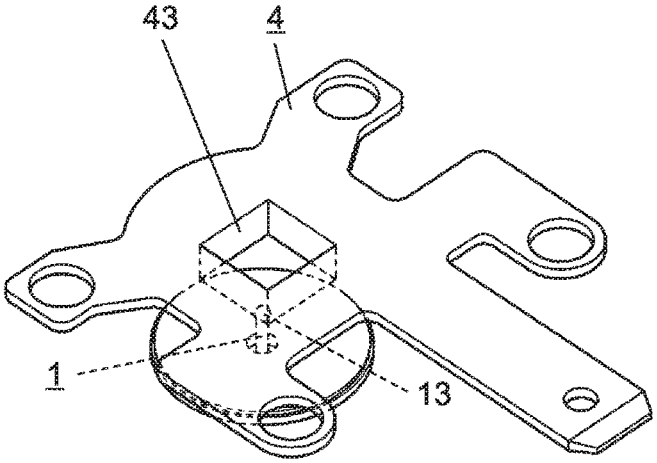
FIG. 6B is a perspective view illustrating a main part of an electrostatic atomizing device according to a fifth exemplary embodiment.

An electrostatic atomizing device according to a fifth exemplary embodiment is described below with reference to FIG. 6B. Detailed description of constituent elements that are similar to those in the second exemplary embodiment is omitted.

In the electrostatic atomizing device according to the present exemplary embodiment, a shape of an opening edge of opening 43 of counter electrode 4 is made polygonal (quadrangular) in order to stably generate leader discharge instead of providing needle-shaped electrode portion 41. Discharge electrode 1 is located at a center of opening 43 when viewed along an axial direction of discharge electrode 1. An inner circumferential surface of opening 43 is made up of a plurality of (four) flat surfaces that are continuous in a circumferential direction. Shortest distances from the flat surfaces to front-end portion 13 of discharge electrode 1 are identical to each other.

In the electrostatic atomizing device according to the present exemplary embodiment, leader discharge can be stably generated between front-end portion 13 of discharge electrode 1 and portions, of the flat surfaces constituting the inner circumferential surface of opening 43, that are closest to front-end portion 13 of discharge electrode 1.

Sixth Exemplary Embodiment

Figure 6C:
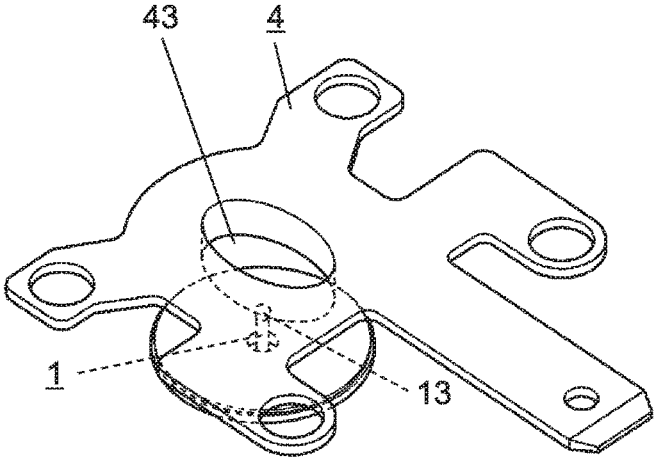
FIG. 6C is a perspective view illustrating a main part of an electrostatic atomizing device according to a sixth exemplary embodiment.

An electrostatic atomizing device according to a sixth exemplary embodiment is described below with reference to FIG. 6C. Detailed description of constituent elements that are similar to those in the second exemplary embodiment is omitted.

In the electrostatic atomizing device according to the present exemplary embodiment, a shape of an opening edge of opening 43 of counter electrode 4 is made oval in order to stably generate leader discharge instead of providing needle-shaped electrode portion 41. Discharge electrode 1 is located at a center of opening 43 when viewed along an axial direction of discharge electrode 1.

In the electrostatic atomizing device according to the present exemplary embodiment, leader discharge can be stably generated between front-end portion 13 of discharge electrode 1 and two portions, of an inner circumferential surface of opening 43, that are closest to front-end portion 13 of discharge electrode 1.

Seventh Exemplary Embodiment

An electrostatic atomizing device according to a seventh exemplary embodiment is described below with reference to FIGS. 7 to 14. Detailed description of constituent elements that are similar to those in the second exemplary embodiment is omitted.

Figure 7:
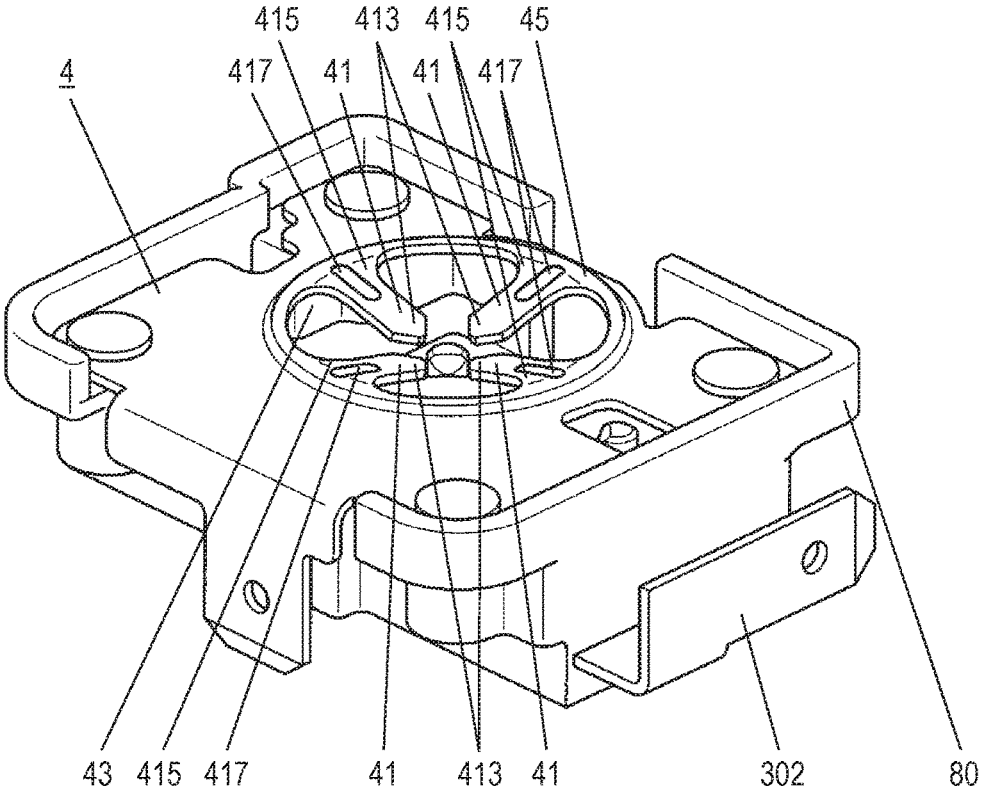
FIG. 7 is a perspective view illustrating an electrostatic atomizing device according to a seventh exemplary embodiment.
Figure 8:
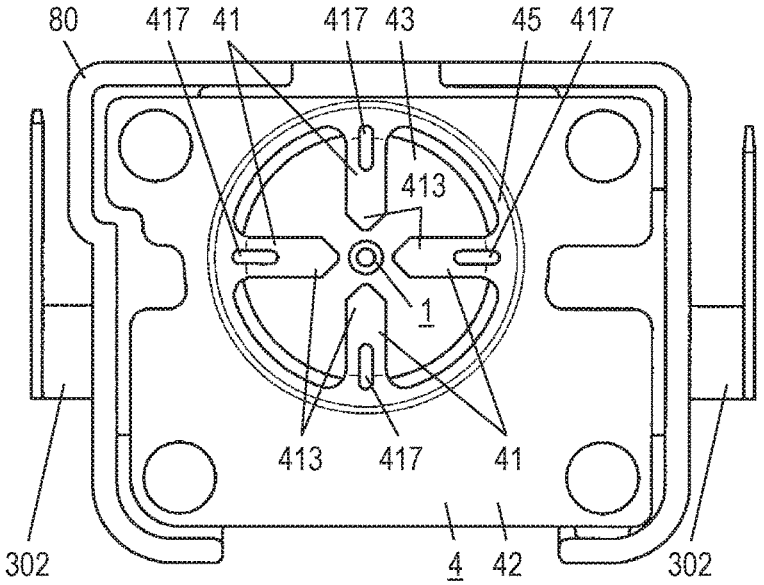
FIG. 8 is a plan view illustrating the electrostatic atomizing device.
Figure 9:
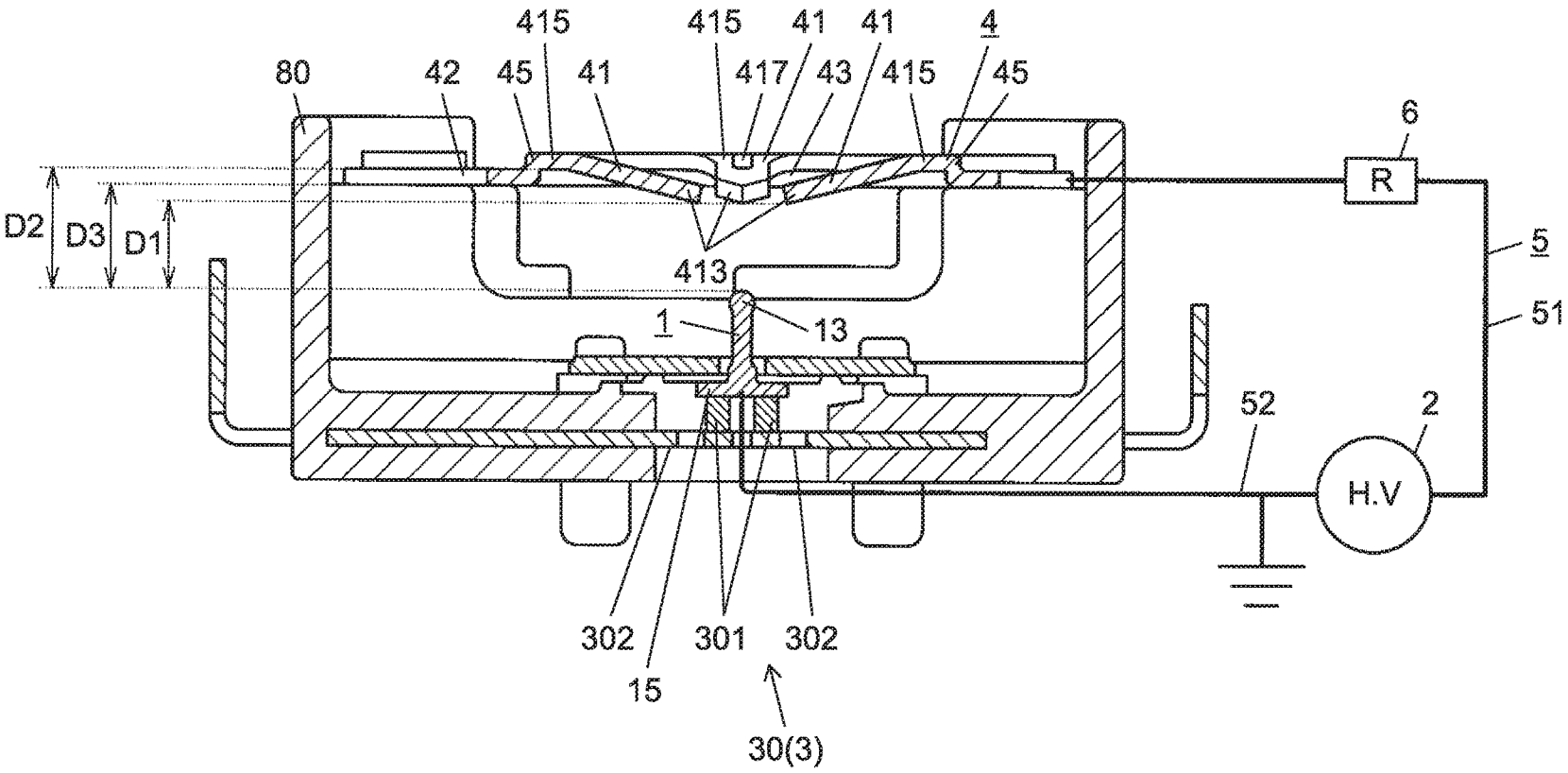
FIG. 9 is a side cross-sectional view illustrating the electrostatic atomizing device.

As illustrated in FIGS. 7 to 9, the electrostatic atomizing device according to the present exemplary embodiment includes discharge electrode 1, voltage applicator 2, liquid supplying unit 3 (cooler 30), counter electrode 4, current path 5, and limiting resistor 6. Discharge electrode 1 and counter electrode 4 are held at predetermined positions in predetermined postures by housing 80. Limiting resistor 6 is disposed in a middle of first current path 51 that electrically connects voltage applicator 2 and counter electrode 4 as in the second exemplary embodiment.

Cooler 30 that constitutes liquid supplying unit 3 is a heat exchanger that includes a pair of Peltier elements 301 and a pair of heat radiating plates 302 that are connected to the pair of Peltier elements 301, respectively, and is configured to cool discharge electrode 1 when an electric current is applied to the pair of Peltier elements 301. Each of heat radiating plates 302 has a portion embedded in housing 80 made of a synthetic resin and an exposed portion that includes a portion connected to Peltier elements 301 and that allows heat to be radiated.

A cooling side of each of Peltier elements 301 is mechanically and electrically connected to base-end portion 15 of discharge electrode 1 through solder. A heating side of each of Peltier elements 301 is mechanically and electrically connected to corresponding one of heat radiating plates 302 through solder. The application of an electric current to the pair of Peltier elements 301 is performed through the pair of heat radiating plates 302 and discharge electrode 1.

Counter electrode 4 includes flat-plate-shaped supporting electrode portion 42 that is held in a posture orthogonal to an axial direction of discharge electrode 1 and four needle-shaped electrode portions 41 that are supported by supporting electrode portion 42 so as to be located closer to discharge electrode 1 than supporting electrode portion 42. The term "orthogonal" as used herein encompasses not only "strictly orthogonal", but also "substantially orthogonal".

Each of needle-shaped electrode portions 41 is a long thin strip-shaped electrode portion and has sharply-pointed front-end portion 413 at one end in a longitudinal direction of needle-shaped electrode portion 41 and base-end portion 415 at the other end in the longitudinal direction of needle-shaped electrode portion 41 (on a side opposite to front-end portion 413). Each of needle-shaped electrode portions 41 extends from a circumferential edge of circular opening 43 of counter electrode 4 toward a center of opening 43. Four needle-shaped electrode portions 41 extend toward one another from four portions that are provided on the circumferential edge of circular opening 43 at regular intervals in a circumferential direction. The term "regular intervals" as used herein encompasses not only "strictly regular intervals", but also "substantially regular intervals".

As illustrated in FIG. 8, front-end portions 413 of needle-shaped electrode portions 41 are located on a same circle around discharge electrode 1 at regular intervals in a circumferential direction of the circle in plan view, i.e., when viewed along the axial direction of discharge electrode 1.

As illustrated in FIGS. 7 and 9, each of needle-shaped electrode portions 41 is held so as to be slightly inclined from a posture parallel with supporting electrode portion 42 (a posture orthogonal to the axial direction of discharge electrode 1). Specifically, front-end portion 413 of each of needle-shaped electrode portions 41 is inclined toward discharge electrode 1. Distance D1 between front-end portion 413 and discharge electrode 1 is smaller than distance D2 between base-end portion 415 and discharge electrode 1 in the axial direction of discharge electrode 1.

By thus setting the posture of each of needle-shaped electrode portions 41, electric field concentration more easily occurs at front-end portion 413 of each of needle-shaped electrode portions 41, and as a result leader discharge more stably occurs between front-end portion 413 of each of needle-shaped electrode portions 41 and front-end portion 13 of discharge electrode 1.

Furthermore, counter electrode 4 includes step portion 45 interposed between supporting electrode portion 42 and base-end portions 415 of needle-shaped electrode portions 41. Step portion 45 constitutes the circumferential edge of opening 43. Each of needle-shaped electrode portions 41 extends from step portion 45 toward the center of opening 43. Since step portion 45 is interposed between supporting electrode portion 42 and needle-shaped electrode portions 41, distance D2 between base-end portion 415 and discharge electrode 1 is larger than distance D3 between supporting electrode portion 42 and discharge electrode 1 in the axial direction of discharge electrode 1.

Since counter electrode 4 includes step portion 45, protrusion of front-end portion 413 of each of needle-shaped electrode portions 41 is kept small. This reduces a risk of deformation of needle-shaped electrode portions 41 caused by contact of front-end portions 413 on some kind of surface when counter electrode 4 is placed on this surface during transportation or assembly.

Furthermore, each of needle-shaped electrode portions 41 has external groove 417 that extends from base-end portion 415 toward front-end portion 413. Groove 417 is formed by pushing and bending part of each of needle-shaped electrode portions 41 in a thickness direction of needle-shaped electrode portions 41. Presence of groove 417 increases a second moment of area of each of needle-shaped electrode portions 41.

The electrostatic atomizing device according to the present exemplary embodiment described above includes four needle-shaped electrode portions 41 and causes leader discharge through a discharge path intermittently formed by dielectric breakdown between front-end portion 413 of each of needle-shaped electrode portions 41 and front-end portion 13 of discharge electrode 1. The leader discharge occurs in a three-dimensionally wider region between discharge electrode 1 and counter electrode 4 than a case where only single needle-shaped electrode portion 41 is provided. A charged microparticle liquid generated by this leader discharge is efficiently discharged to an outside through opening 43 along a direction of an electric field formed between four needle-shaped electrode portions 41 and discharge electrode 1.

In addition, in the electrostatic atomizing device according to the present exemplary embodiment, front-end portions 413 of respective four needle-shaped electrode portions 41 are located on the same circle at regular intervals in the circumferential direction of the circle. This allows the generated charged microparticle liquid to be more efficiently discharged through opening 43.

A number of needle-shaped electrode portions 41 is not limited to four as long as a plurality of needle-shaped electrode portions 41 are provided. It is, however, preferable that three or more needle-shaped electrode portions 41 be provided in order to efficiently discharge a charged microparticle liquid to an outside.

Figure 10A:
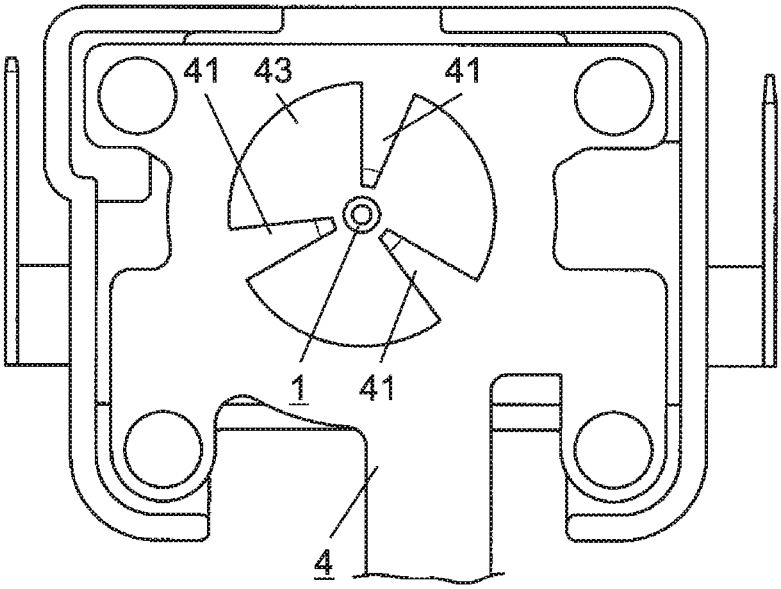
FIG. 10A is a plan view illustrating a modification of the electrostatic atomizing device.
Figure 10B:
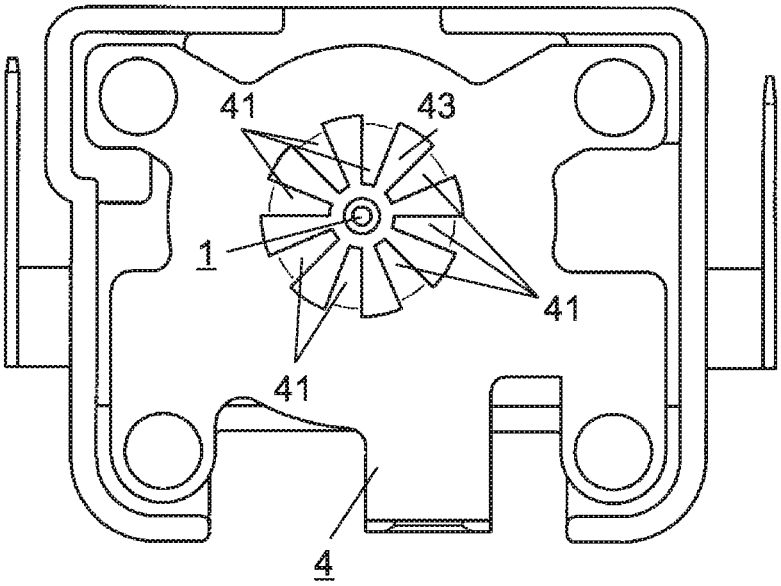
FIG. 10B is a plan view illustrating another modification of the electrostatic atomizing device.

FIGS. 10A and 10B each illustrate a modification. The modification illustrated in FIG. 10A is a modification in which counter electrode 4 includes three needle-shaped electrode portions 41, and the modification illustrated in FIG. 10B is a modification in which counter electrode 4 includes eight needle-shaped electrode portions 41. In these modifications, groove 417 and step portion 45 are omitted.

In counter electrode 4 having three or more needle-shaped electrode portions 41 in opening 43, it is preferable that an opening area of opening 43 be set larger than a total area of three or more needle-shaped electrode portions 41 when viewed along the axial direction of discharge electrode 1. In a case where the opening area is thus set, an electric field is more easily concentrated at front-end portions 413 of needle-shaped electrode portions 41, and thus leader discharge more stably occurs.

In a case where counter electrode 4 includes a plurality of needle-shaped electrode portions 41 as in the electrostatic atomizing device according to the present exemplary embodiment, it is desirable that front-end portions 413 of respective needle-shaped electrode portions 41 be as uniform as possible in strength of electric field concentration. In a case where strength of electric field concentration greatly varies, a charged microparticle liquid is not efficiently discharged through opening 43.

Figure 11:
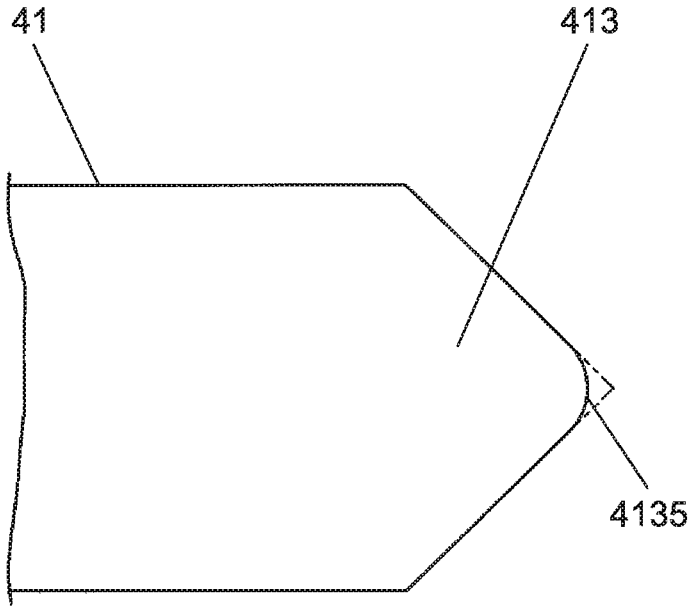
FIG. 11 is a plan view illustrating a main part of another modification of the electrostatic atomizing device.

FIG. 11 illustrates a modification in which tip 4135 of front-end portion 413 of each of needle-shaped electrode portions 41 is rounded. Tip 4135 is a corner portion that is located at a front-most end when each of needle-shaped electrode portions 41 is viewed from a thickness direction of needle-shaped electrode portion 41. In a case where front-end portion 413 of each of needle-shaped electrode portions 41 is rounded, electric field concentration is mitigated to some extent. This prevents a large variation in strength of electric field concentration from occurring due to a manufacturing variation during molding of needle-shaped electrode portions 41.

Figure 12A:
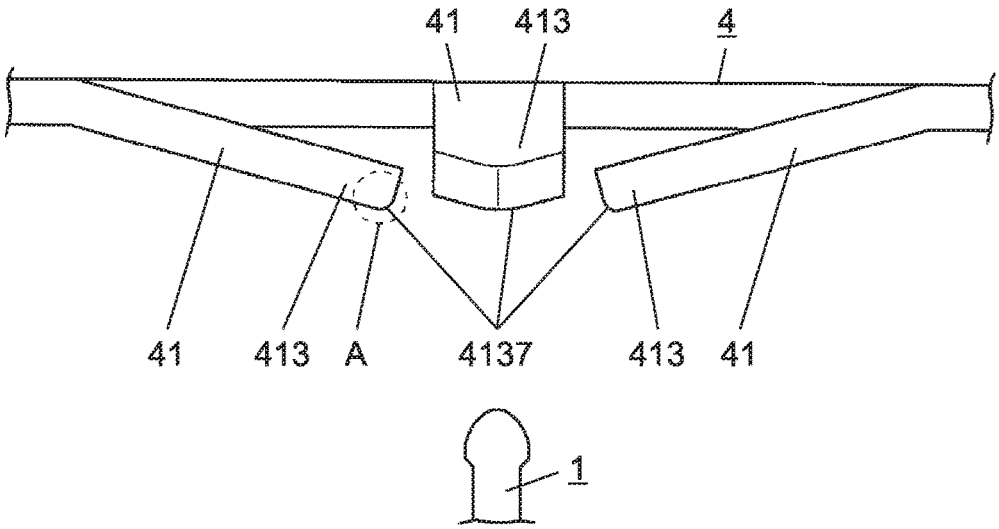
FIG. 12A is a side view illustrating a main part of another modification of the electrostatic atomizing device.
Figure 12B:
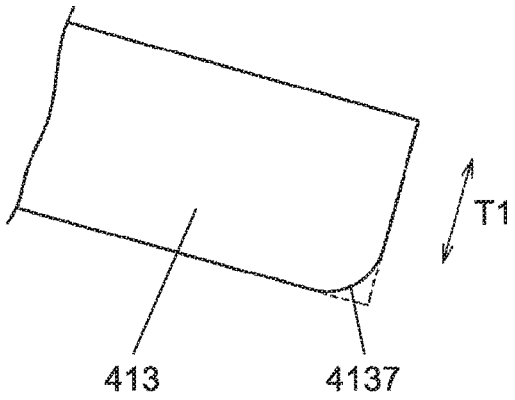
FIG. 12B is an enlarged view of the A portion of FIG. 12A.

FIGS. 12A and 12B each illustrate a modification in which end edge portion 4137 of front-end portion 413 of each of needle-shaped electrode portions 41 is chamfered. End edge portion 4137 is one of end edge portions on both sides in thickness direction T1 (see FIG. 12B) of front-end portion 413 that is closer to discharge electrode 1. Since end edge portion 4137 of each of needle-shaped electrode portions 41 is chamfered, electric field concentration is mitigated to some extent. This prevents a large variation in strength of electric field concentration from occurring due to a manufacturing variation during molding of needle-shaped electrode portions 41.

Figure 13:
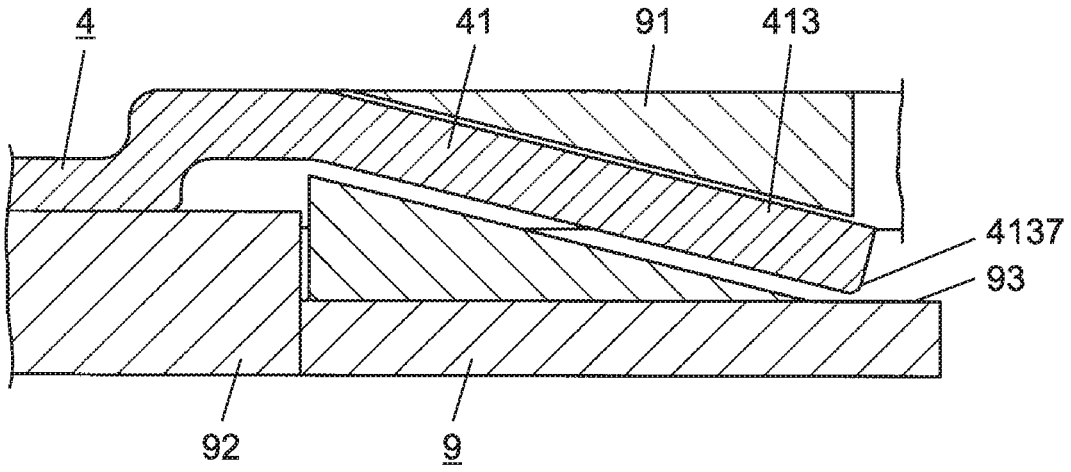
FIG. 13 is a cross-sectional view illustrating a step of molding a needle-shaped electrode portion of the modification illustrated in FIGS. 12A and 12B.

FIG. 13 illustrates a main part of molding device 9 that chamfers end edge portion 4137 of each of needle-shaped electrode portions 41. Molding device 9 includes upper mold 91 and lower mold 92 for bending. When needle-shaped electrode portions 41 are bent between upper mold 91 and lower mold 92, molding device 9 chamfers end edge portions 4137 of needle-shaped electrode portions 41 by causing end edge portions 4137 to be collectively flattened out on a flat surface 93 on lower mold 92 side. According to molding device 9, when needle-shaped electrode portions 41 are bent, end edge portions 4137 can be chamfered concurrently. In addition, positions of front-end portions 413 (positions of end edge portions 4137) of respective needle-shaped electrode portions 41 are made to be uniform when needle-shaped electrode portions 41 are chamfered. This produces an advantage of making distances from front-end portions 413 of respective needle-shaped electrode portions 41 to discharge electrode 1 uniform.

In these modifications, electric field concentration at front-end portions 413 of respective needle-shaped electrode portions 41 is mitigated, and a variation in strength of electric field concentration is made small. However, mitigation of electric field concentration tends to inhibit development into leader discharge. However, development into leader discharge is stably promoted since the opening area of opening 43 is set larger than the total area of the plurality of needle-shaped electrode portions 41 as described above.

Figure 14:
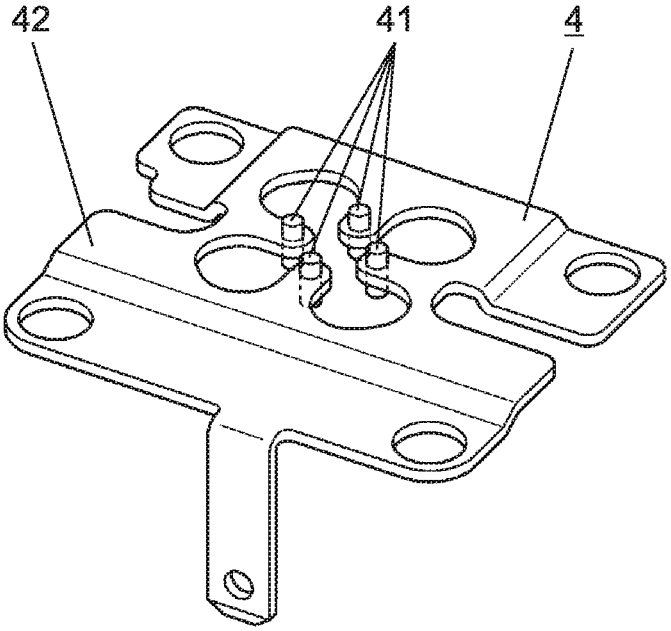
FIG. 14 is a perspective view illustrating a main part of another modification of the electrostatic atomizing device.

FIG. 14 illustrates a modification in which needle-shaped electrode portions 41 and supporting electrode portion 42 of counter electrode 4 are made of different materials. In this modification, needle-shaped electrode portions 41 exposed to leader discharge may be made of a material such as titanium or tungsten that has high resistance to discharge, and supporting electrode portion 42 may be made of a material such as stainless steel that has resistance to discharge lower than resistance to discharge in needle-shaped electrode portions 41. This modification has an advantage of increasing resistance of counter electrode 4 to leader discharge with an inexpensive structure.

Eighth Exemplary Embodiment

An electrostatic atomizing device according to an eighth exemplary embodiment is described below with reference to FIGS. 15A to 19. Detailed description of constituent elements that are similar to those in the second exemplary embodiment is omitted.

Figure 15A:
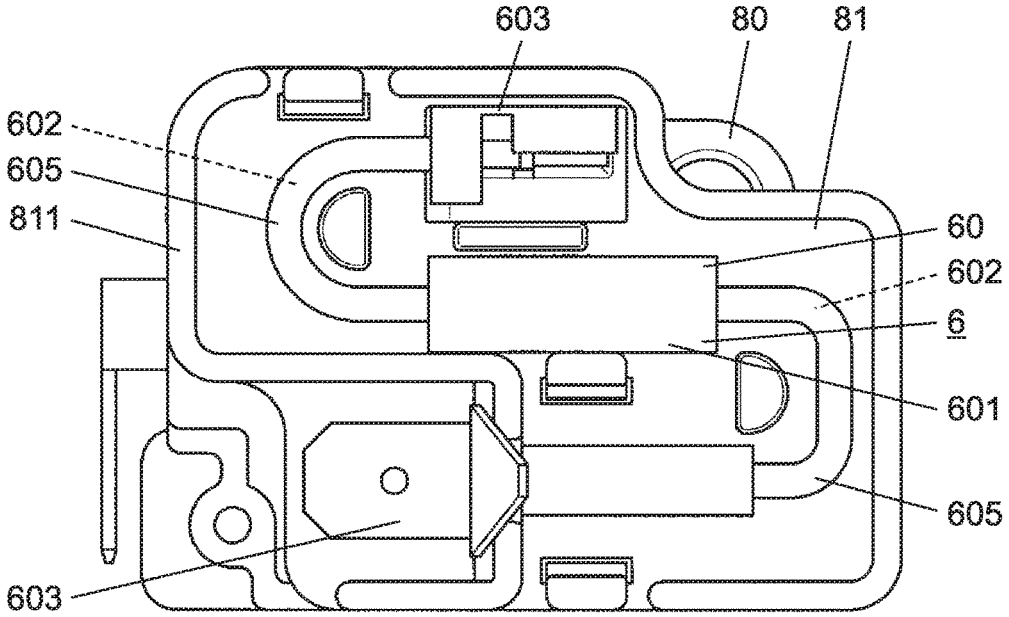
FIG. 15A is a bottom view illustrating an electrostatic atomizing device according to an eighth exemplary embodiment.

As illustrated in FIG. 15A, limiting resistor 6 provided in the electrostatic atomizing device according to the present exemplary embodiment is resistor 60 for high voltage using a dedicated element. Resistor 60 includes resistive element 601, a pair of lead wires 602 that are electrically and mechanically connected to resistive element 601, and terminals 603 that are electrically and mechanically connected to ends of respective lead wires 602. In resistor 60 for high voltage, each of lead wires 602 is typically constituted by a single wire and is vulnerable to bending (vulnerable especially to repeated bending). In view of this, each of lead wires 602 is covered with flexible cover 605 that makes it harder for lead wire 602 to bend. Lead wires 602 that are covered with covers 605 keep a large radius of curvature during bending. This mitigates stress concentration caused by bending.

Figure 15B:
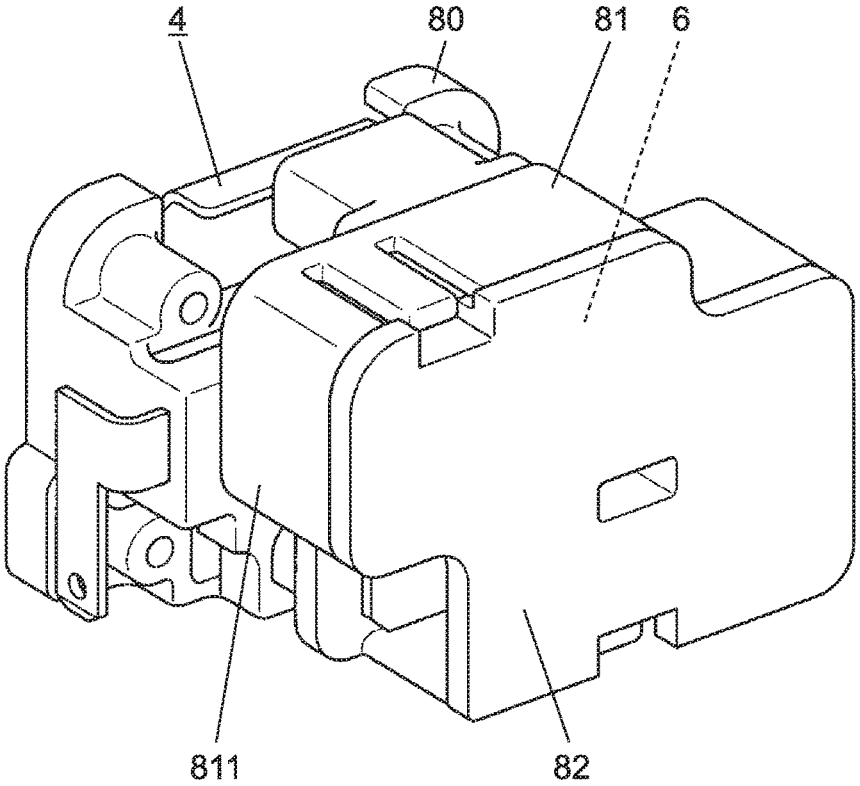
FIG. 15B is a perspective view illustrating a case where the electrostatic atomizing device is provided with a lid.

As illustrated in FIGS. 15A and 15B, the electrostatic atomizing device according to the present exemplary embodiment includes fixing base 81 for fixing resistor 60. Fixing base 81 is integral with housing 80 that supports discharge electrode 1 and counter electrode 4.

Resistive element 601 and terminals 603 are fixed at predetermined positions on fixing base 81. As a result, lead wires 602 are held at predetermined positions of fixing base 81. This keeps a risk of repeated bending of lead wires 602 low. Peripheral wall 811 rises from peripheral edge of fixing base 81. Peripheral wall 811 is located so as to surround at least resistive element 601 and the pair of lead wires 602 of resistor 60.

As illustrated in FIG. 15B, lid 82 can be detachably attached to fixing base 81. Resistive element 601 and the pair of lead wires 602 are covered with peripheral wall 811 and lid 82 so as to be untouchable from an outside.

Figure 16:
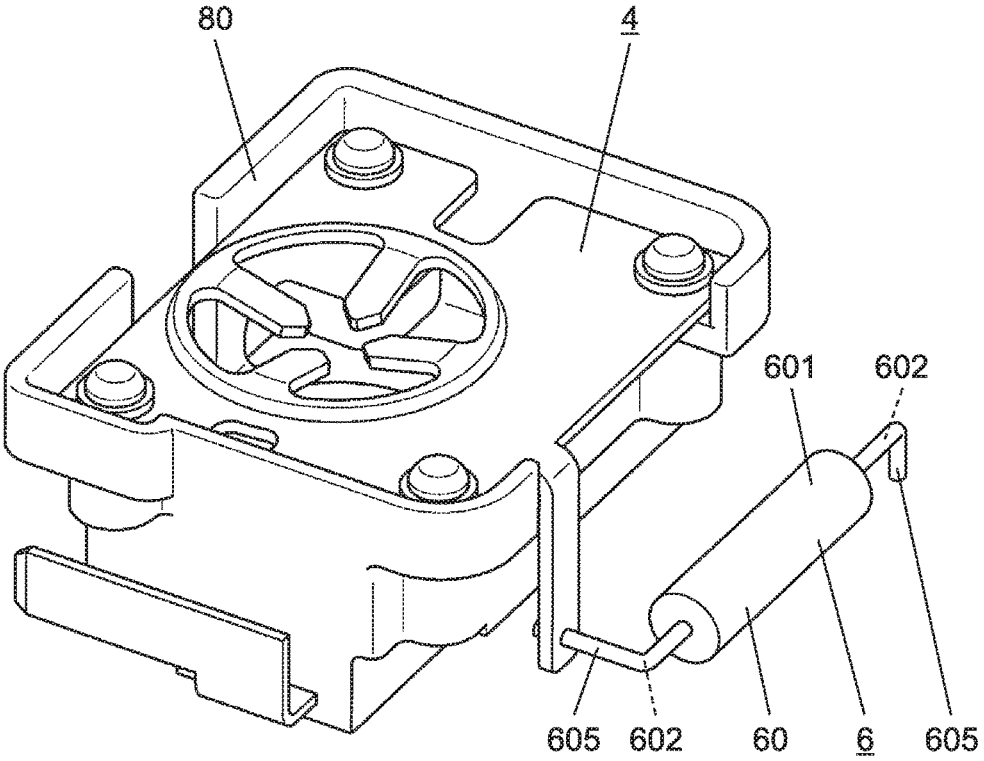
FIG. 16 is a perspective view illustrating a modification of the electrostatic atomizing device.
Figure 17:
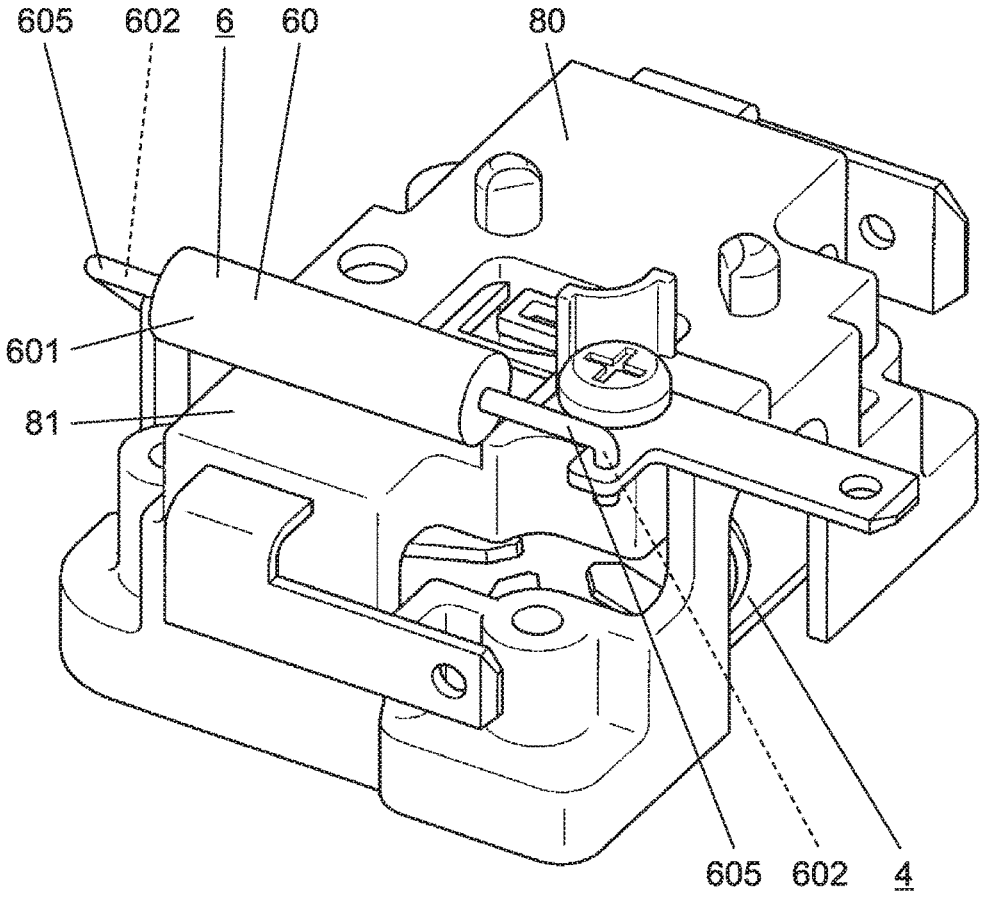
FIG. 17 is a perspective view illustrating another modification of the electrostatic atomizing device.

FIGS. 16 and 17 each illustrate a modification in which resistor 60 is provided without providing fixing base 81 illustrated in FIGS. 15A and 15B. In the modification illustrated in FIG. 16, one lead wire 602 of resistor 60 is directly connected electrically and mechanically to counter electrode 4.

In the modification illustrated in FIG. 17, resistor 60 is directly connected electrically and mechanically to counter electrode 4, and resistor 60 is fixed to an external surface of housing 80. In this modification, a rear surface side of housing 80 (a side opposite to a side where counter electrode 4 is located) serves as fixing base 81.

The modifications illustrated in FIGS. 16 and 17 are examples in which limiting resistor 6 is directly attached to counter electrode 4, in other words, examples in which a length of a wire between counter electrode 4 and limiting resistor 6 is set to 0 mm. In a case where limiting resistor 6 is disposed on first current path 51, the length of the wire between counter electrode 4 and limiting resistor 6 is preferably set within a range from 0 mm to 30 mm. This is because electric current resistance is very small during flow of an instantaneous electric current through a discharge path created by dielectric breakdown and therefore when the length of the wire between counter electrode 4 and limiting resistor 6 is longer than 30 mm, discharge becomes unstable due to influence of floating capacitance of the wire.

Figure 18A:
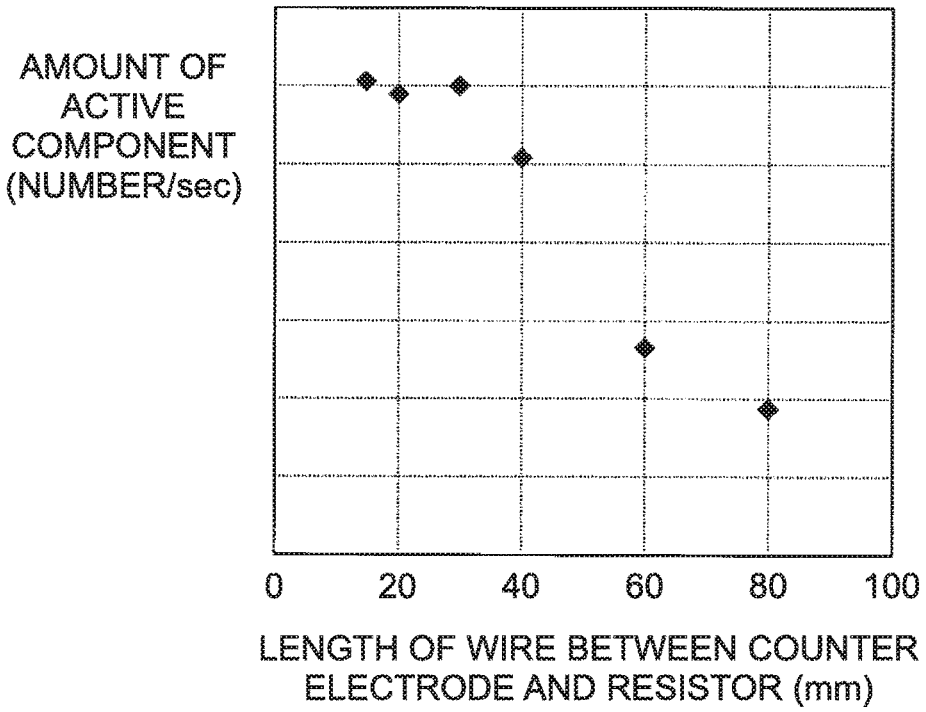
FIG. 18A is a graph illustrating a relationship between a length of a wire between a counter electrode and a resistor and an amount of active component.

It is also confirmed from a measurement result shown in the graph of FIG. 18A that when the length of the wire between counter electrode 4 and limiting resistor 6 is longer than 30 mm, an amount of active component (an amount of radicals) generated by leader discharge decreases. Although no numerical value is shown on the vertical axis of FIG. 18A, an upper limit of the amount of generated radicals is approximately 5 trillion per sec.

In a case where limiting resistor 6 is disposed on first current path 51, a length of a wire between voltage applicator 2 and limiting resistor 6 on first current path 51 is preferably set within a range from 0 mm to 200 mm. This is because electric current resistance is very small during flow of an instantaneous electric current and therefore when the length of the wire between voltage applicator 2 and limiting resistor 6 is longer than 200 mm, discharge becomes unstable due to influence of floating capacitance of the wire.

Figure 18B:
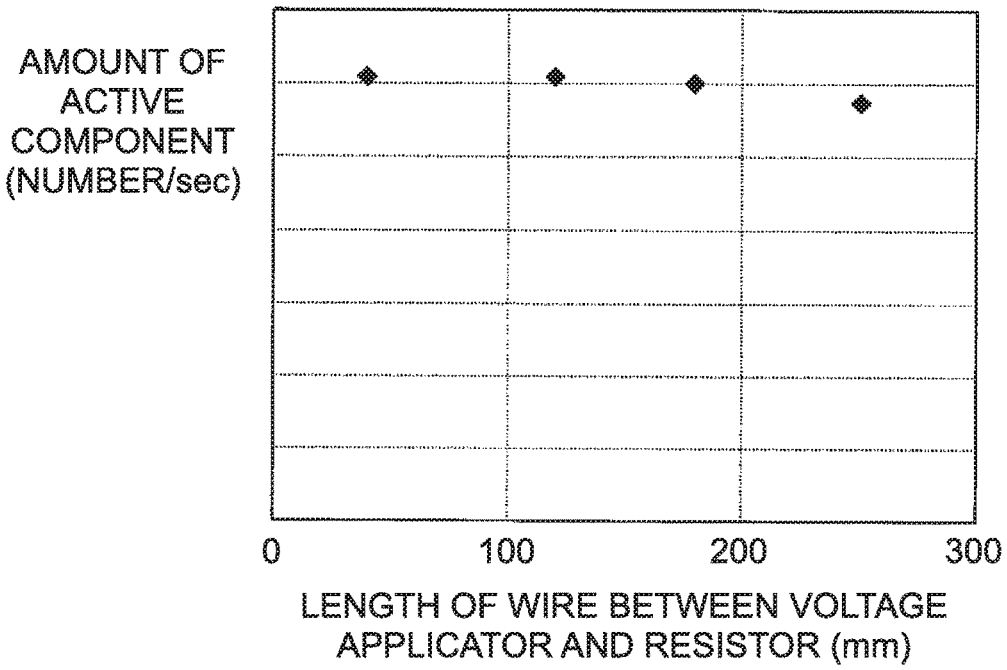
FIG. 18B is a graph illustrating a relationship between a length of a wire between a voltage applicator and a resistor and an amount of active component.

It is also confirmed from a measurement result shown in the graph of FIG. 18B that when the length of the wire between voltage applicator 2 and limiting resistor 6 is longer than 200 mm, an amount of active component (an amount of radicals) generated by leader discharge decreases. Also in FIG. 18B, an upper limit of the amount of generated radicals is approximately 5 trillion per sec.

Figure 19:
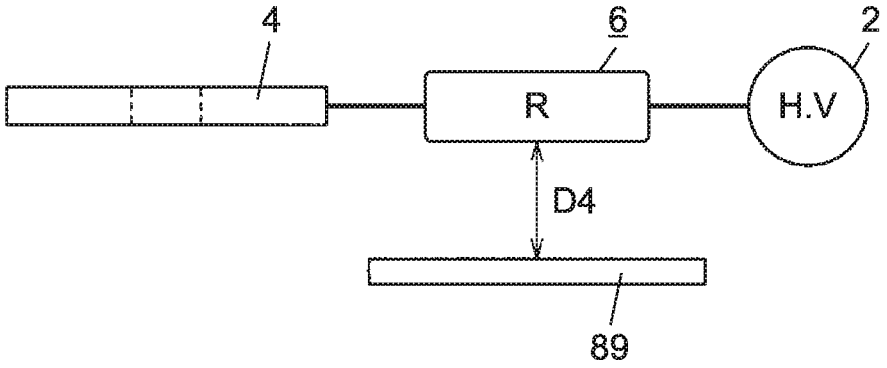
FIG. 19 is a schematic view illustrating a device used for measurement of the graphs of FIGS. 18A and 18B.

The measurement results shown in the graphs of FIGS. 18A and 18B are results measured by using a device schematically illustrated in FIG. 19. In this device, limiting resistor 6 is disposed on a wire that electrically connects counter electrode 4 and voltage applicator 2, and metal plate 89 that serves as ground is disposed at a position away from limiting resistor 6 by distance D4 (=4 mm). An amount of radicals generated by leader discharge was measured by applying a high voltage of 7.0 kV between counter electrode 4 and a discharge electrode (not illustrated).

These results are results obtained in a case where limiting resistor 6 is disposed on first current path 51, but similar results are obtained also in a case where limiting resistor 6 is disposed on second current path 52 that electrically connects discharge electrode 1 and voltage applicator 2 (see FIG. 3).

That is, when limiting resistor 6 is disposed on second current path 52, a length of a wire between discharge electrode 1 and limiting resistor 6 on second current path 52 is preferably set to 30 mm or less in order to stably cause leader discharge. Furthermore, a length of a wire between voltage applicator 2 and limiting resistor 6 on second current path 52 is preferably set to 200 mm or less in order to stably cause leader discharge.

As described above, an electrostatic atomizing device according to the present disclosure generates a charged microparticle liquid containing radicals by leader discharge while keeping an increase in ozone small, and is therefore applicable to various uses such as a refrigerator, a washing machine, a drier, an air conditioner, an electric fan, an air purifier, a humidifier, a beauty care machine, and an automobile.

What is claimed is:

1. An electrostatic atomizing device comprising:

a discharge electrode;

a counter electrode that is located so as to face the discharge electrode;

a liquid supplying unit that supplies a liquid for electrostatic atomization to the discharge electrode;

a current path that electrically connects the discharge electrode and the counter electrode;

a voltage applicator that is disposed on the current path, applies a voltage across the discharge electrode and the counter electrode, and thus intermittently generates a discharge path due to dielectric breakdown so that the discharge electrode and the counter electrode are connected to each other; and a limiting resistor that is disposed on the current path, wherein:

the limiting resistor is disposed on a first current path or a second current path included in the current path, the first current path electrically connecting the voltage applicator and the counter electrode, and the second current path electrically connecting the voltage applicator and the discharge electrode, the limiting resistor is disposed on the first current path, and a length of a wire between the counter electrode and the limiting resistor on the first current path is set to 30 mm or less.

2. The electrostatic atomizing device according to claim 1, wherein the limiting resistor is directly connected to the counter electrode electrically and mechanically.

3. An electrostatic atomizing device comprising:

a discharge electrode;

a counter electrode that is located so as to face the discharge electrode;

a liquid supplying unit that supplies a liquid for electrostatic atomization to the discharge electrode;

a current path that electrically connects the discharge electrode and the counter electrode;

a voltage applicator that is disposed on the current path, applies a voltage across the discharge electrode and the counter electrode, and thus intermittently generates a discharge path due to dielectric breakdown so that the discharge electrode and the counter electrode are connected to each other; and a limiting resistor that is disposed on the current path, wherein:

the limiting resistor is disposed on a first current path or a second current path included in the current path, the first current path electrically connecting the voltage applicator and the counter electrode, and the second current path electrically connecting the voltage applicator and the discharge electrode, the limiting resistor is disposed on the first current path, and a length of a wire between the voltage applicator and the limiting resistor on the first current path is set to 200 mm or less.

4. An electrostatic atomizing device comprising:

a discharge electrode;

a counter electrode that is located so as to face the discharge electrode;

a liquid supplying unit that supplies a liquid for electrostatic atomization to the discharge electrode;

a current path that electrically connects the discharge electrode and the counter electrode;

a voltage applicator that is disposed on the current path, applies a voltage across the discharge electrode and the counter electrode, and thus intermittently generates a discharge path due to dielectric breakdown so that the discharge electrode and the counter electrode are connected to each other; and a limiting resistor that is disposed on the current path, wherein:

the limiting resistor is disposed on a first current path or a second current path included in the current path, the first current path electrically connecting the voltage applicator and the counter electrode, and the second current path electrically connecting the voltage applicator and the discharge electrode, the limiting resistor is disposed on the second current path, and a length of a wire between the discharge electrode and the limiting resistor on the second current path is set to 30 mm or less.

5. An electrostatic atomizing device comprising:

a discharge electrode;

a counter electrode that is located so as to face the discharge electrode;

a liquid supplying unit that supplies a liquid for electrostatic atomization to the discharge electrode;

a current path that electrically connects the discharge electrode and the counter electrode;

a voltage applicator that is disposed on the current path, applies a voltage across the discharge electrode and the counter electrode, and thus intermittently generates a discharge path due to dielectric breakdown so that the discharge electrode and the counter electrode are connected to each other; and a limiting resistor that is disposed on the current path, wherein:

the limiting resistor is disposed on a first current path or a second current path included in the current path, the first current path electrically connecting the voltage applicator and the counter electrode, and the second current path electrically connecting the voltage applicator and the discharge electrode, the limiting resistor is disposed on the second current path, and a length of a wire between the voltage applicator and the limiting resistor on the second current path is set to 200 mm or less.

6. An electrostatic atomizing device comprising:

a discharge electrode;

a counter electrode that is located so as to face the discharge electrode;

a liquid supplying unit that supplies a liquid for electrostatic atomization to the discharge electrode;

a current path that electrically connects the discharge electrode and the counter electrode;

a voltage applicator that is disposed on the current path, applies a voltage across the discharge electrode and the counter electrode, and thus intermittently generates a discharge path due to dielectric breakdown so that the discharge electrode and the counter electrode are connected to each other; and a limiting resistor that is disposed on the current path, wherein:

the limiting resistor is disposed on a first current path or a second current path included in the current path, the first current path electrically connecting the voltage applicator and the counter electrode, and the second current path electrically connecting the voltage applicator and the discharge electrode, the limiting resistor is a resistor that includes a resistive element and a lead wire electrically connected to the resistive element, and the lead wire is covered with a cover for making the lead wire harder to bend.

7. An electrostatic atomizing device comprising:

a discharge electrode;

a counter electrode that is located so as to face the discharge electrode;

a liquid supplying unit that supplies a liquid for electrostatic atomization to the discharge electrode;

a current path that electrically connects the discharge electrode and the counter electrode;

a voltage applicator that is disposed on the current path, applies a voltage across the discharge electrode and the counter electrode, and thus intermittently generates a discharge path due to dielectric breakdown so that the discharge electrode and the counter electrode are connected to each other;

a limiting resistor that is disposed on the current path; and a fixing base on which the limiting resistor is fixed, wherein:

the limiting resistor is disposed on a first current path or a second current path included in the current path, the first current path electrically connecting the voltage applicator and the counter electrode, and the second current path electrically connecting the voltage applicator and the discharge electrode, and the limiting resistor is a resistor that includes a resistive element and a lead wire electrically connected to the resistive element.

* * * * *